US008080744B2

(12) United States Patent
Yeh et al.

(10) Patent No.: US 8,080,744 B2
(45) Date of Patent: Dec. 20, 2011

(54) KEYBOARD AND KEYSWITCH

(75) Inventors: Liang-Ta Yeh, Shulin (TW); Chih-Chung Yen, Bade (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 339 days.

(21) Appl. No.: 12/558,653

(22) Filed: Sep. 14, 2009

(65) Prior Publication Data

US 2010/0065409 A1 Mar. 18, 2010

(30) Foreign Application Priority Data

Sep. 17, 2008 (TW) ..... 97216796 U
Sep. 17, 2008 (TW) ..... 97216797 U

(51) Int. Cl.
*H01H 9/26* (2006.01)

(52) U.S. Cl. ..... 200/5 A

(58) Field of Classification Search ..... 200/5 A, 200/517, 344, 345, 314, 317, 512; 400/490–496
See application file for complete search history.

(56) References Cited

U.S. PATENT DOCUMENTS 5,278,371 A * 1/1994 Watanabe et al. ..... 200/344
5,695,047 A * 12/1997 Tanahashi ..... 200/344
5,878,872 A * 3/1999 Tsai ..... 200/344
6,366,275 B1 * 4/2002 Lai ..... 345/168
6,958,458 B1 * 10/2005 Tsai ..... 200/344

* cited by examiner

*Primary Examiner* — Edin A. Leon
(74) *Attorney, Agent, or Firm* — Winston Hsu; Scott Margo

(57) ABSTRACT

The invention discloses a keyswitch including a keycap, a base plate, and a support frame. The keycap includes an engagement part, and the base plate includes a slide part. The support frame is between the keycap and the base plate and includes a first end and a second end. The first end is connected to the engagement part of the keycap, and the second end slides in the slide part of the base plate. The engagement part includes a first concave part and a second concave part, and a radial dimension of the first concave part is different from a radial dimension of the second concave part. The first end of the support frame includes a first protrusion part and a second protrusion part, and a radial dimension of the first protrusion part is different from a radial dimension of the second protrusion part. The first protrusion part and the second protrusion part respectively are engaged with the first concave part and the second concave part respectively.

14 Claims, 11 Drawing Sheets

KEYBOARD AND KEYSWITCH

BACKGROUND OF THE INVENTION

1. Field of the Invention

This invention relates to a keyswitch and a keyboard, and more particularly relates to a keyswitch and a keyboard capable of assisting to position keycaps.

2. Description of the Prior Art

Up to now, in countries with information development, almost every family has a computer. People obtain information they need over a network by use of computers or communicate with others through the communication programs within the computers. The main input methods of information products include keyboards, mice, and touch panels. The most developed therein is the keyboard. The keyboard is not a novel product, but it is quite close to users. To input a text more conveniently still needs a keyboard, because the input through a touch panel is not intuitive and inconvenient.

The common input device on a computer is a keyboard, and the basic element of the keyboard is a keyswitch. Please refer to FIG. 1. FIG. 1 is a schematic drawing illustrating a keyswitch 16 according to the prior art. As shown in FIG. 1, the keyswitch 16 of the prior art includes a keycap 10, a support structure 12, and a base plate 14. The support structure 12 is a scissors-shaped structure including a first support frame 120 and a second support frame 122. Therein, a first end 1200 of the first support frame 120 is connected to an engagement part 100 of the keycap 10, and a second end 1202 of the first support frame 120 slides in a slide part 140 of the base plate 14.

Therefore, when the keycap 10 is pressed, the support structure 12 transforms from an X-shaped frame with a higher height to that with a lower height, so that the keycap 10 could substantially vertically move relative to the base plate 14. However, in fact, the movement of the keycap 10 includes not only vertical movement, but also lateral movement. As shown in FIG. 1, the first end 1200 of the first support frame 120 is a cylinder. When the keycap 10 moves laterally, the maximum movement distance between the engagement part 100 and the first end 1200 is the height of the cylinder.

In other words, when the keycap 10 is knocked, the keycap 10 moves not only along the direction of the knock but also along the extension direction of the first end 1200 of the first support frame 120. The keycap 10 is easy to sway so that the feedback feeling of the knock on the keycap 10 is not good.

Therefore, a scope of the invention is to provide a keyswitch and a keyboard to solve the above problems.

SUMMARY OF THE INVENTION

A scope of the invention is to provide a keyswitch for providing a better effect of positioning and engagement so as to reduce the displacement of a keycap thereof due to vibration.

The keyswitch of the invention includes a keycap, a base plate, and a first support frame. The keycap includes a first engagement part. The base plate includes a first slide part. The first support frame is disposed between the keycap and the base plate and includes a first end and a second end. The first end is connected to the first engagement part of the keycap. The second end slides in the first slide part of the base plate.

Therein, the first engagement part includes a first concave part. The first end of the first support frame includes a first protrusion part and a second part. The radial dimension of the first protrusion part is different from the radial dimension of the second protrusion part. The first protrusion part is engaged with the first concave part of the first engagement part. In an embodiment, the second protrusion part is exposed out and adjacent to a side of the first engagement part. The movement of the keycap is therefore limited by the protrusion structure protruding out of the side of the first engagement part, so as to increase the stability of the operation of the keycap. In another embodiment, the first engagement part includes a second concave part. The radial dimension of the first concave part is different from the radial dimension of the second concave part. The second protrusion is engaged with the second concave part of the first engagement. The first support frame and the first engagement constrain each other in structure by the correspondingly-engaged structure, and the stability of the operation of the keycap is therefore increased.

In addition, the keycap of the invention a second support frame. The keycap includes a second slide part. The base plate includes a second engagement part. The second support frame is cross connected to the first support frame and includes a third end and a fourth end. The third end is connected to the second engagement part of the base plate. The fourth end slides in the second slide part of the keycap.

Another scope of the invention is to provide a keyboard for providing a better effect of positioning and engagement so as to reduce the displacement of keycaps thereof due to vibration.

The keyboard of the invention includes a plurality of keycaps, a base plate, and a plurality of first support frames. Each keycap is correspondingly connected to one of the first support frames, and the first support frames are connected to the base plate. The structure relation and the operation of the keycaps, the first support frames, and the base plate are the same as described in the description of the keycap of the invention, and it is not described more here.

As described above, the engagement structure of the support frame to the keycap is improved in the invention. The first end of the support frame further includes a protrusion structure exposed out and adjacent to the side of the engagement part of the keycap or includes a protrusion part with different radial dimensions. The protrusion structure could limit the movement of the keycap. The keycap includes concave parts with different radial dimensions corresponding to the protrusion part with different radial dimensions, the protrusion parts are correspondingly engaged with the concave parts so that they could constrain each other so that the keyswitch is uneasy to sway. Therefore, the invention improved the structure of the protrusion part and the concave part to limit the movement of the keycap; that is, the invention provides a better effect of positioning the keycap. Besides, the keyswitch of the invention is uneasy to sway so that the wear due to the movement between the components could be reduced and the stability of the knock on the keyswitch is increased; that is, the feedback feeling of knock is improved. In addition, the protrusion structure exposed out of the engagement part of the keycap could raise the resistance force as extracting the keycap, and the raised extraction force of the keycap could make the keycap be connected to the support structure more firmly.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
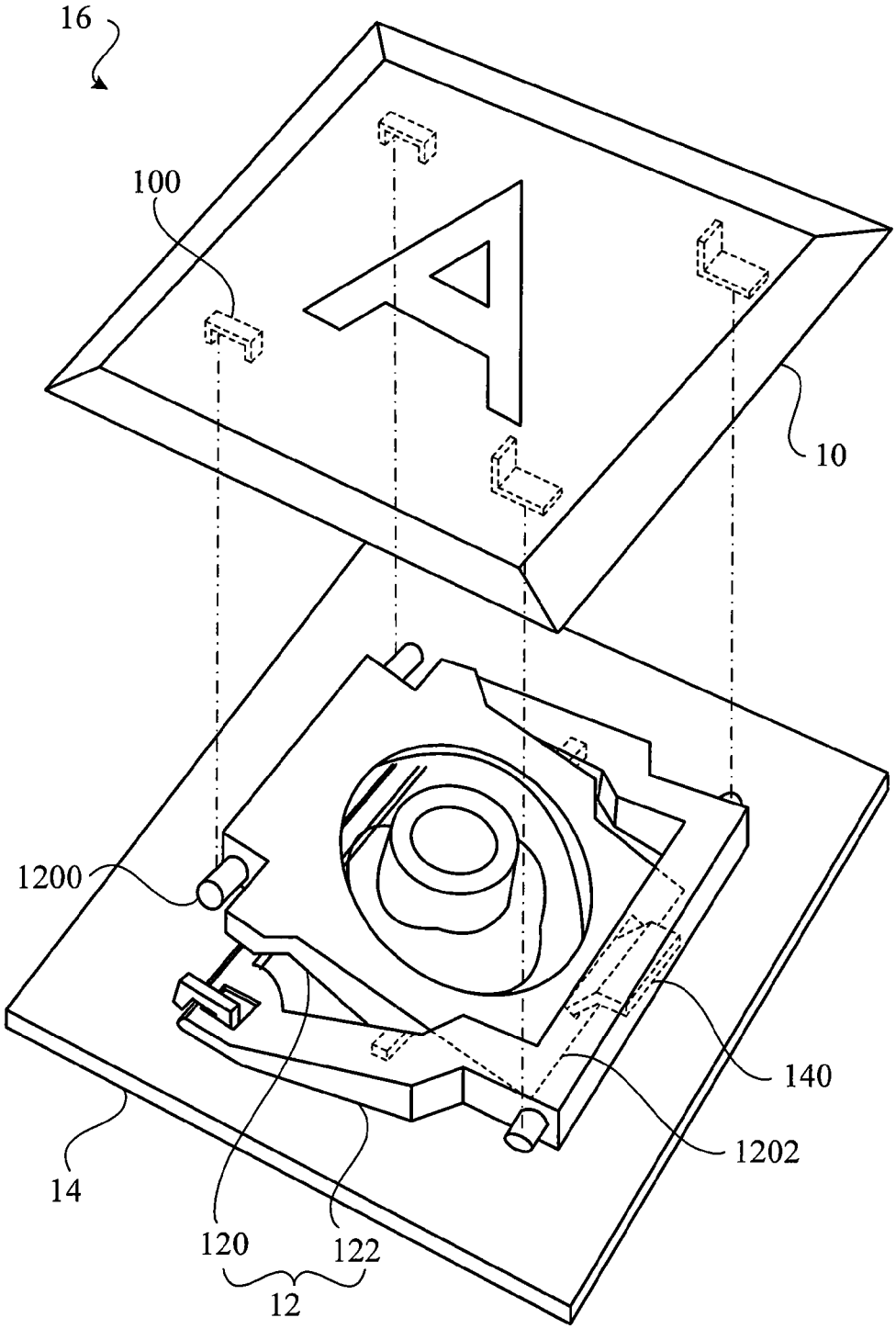
FIG. 1 (prior art)
FIG. 1 is a schematic drawing illustrating a keyswitch according to the prior art.
Figure 2:
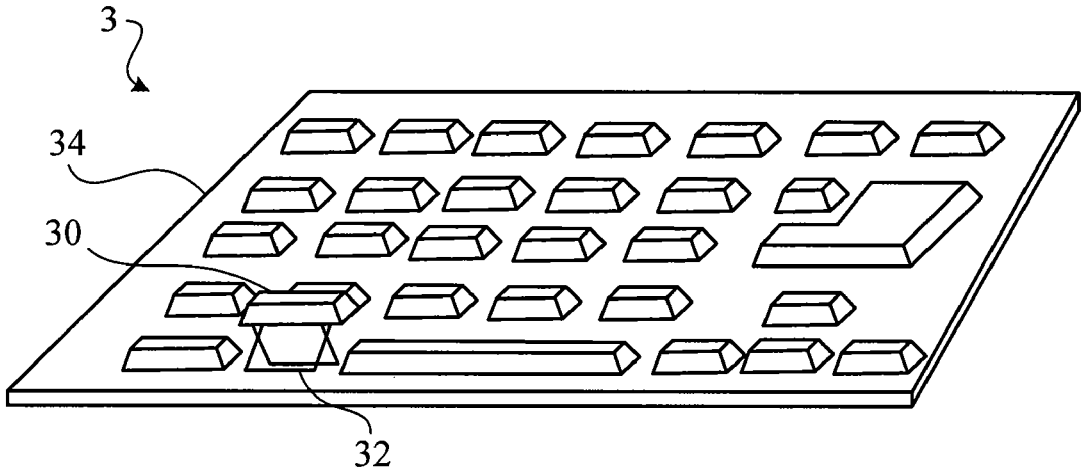
FIG. 2 is a schematic drawing illustrating a keyboard of an embodiment according to the invention.

Please refer to FIG. 2. FIG. 2 is a schematic drawing illustrating a keyboard 3 of an embodiment according to the invention. As shown in FIG. 2, the keyboard 3 includes a base plate 34, a plurality of keycaps 30, and a plurality of support structures 32. There is one of the support structures 32 between the base plate 34 and each keycap 30, and the support structure 32 allows the keycap 30 to be capable of vertically moving relative to the base plate 34. In the invention, one keycap 30, one support structure 32, and the base plate 34 is a so-called keyswitch 36.

Figure 3:
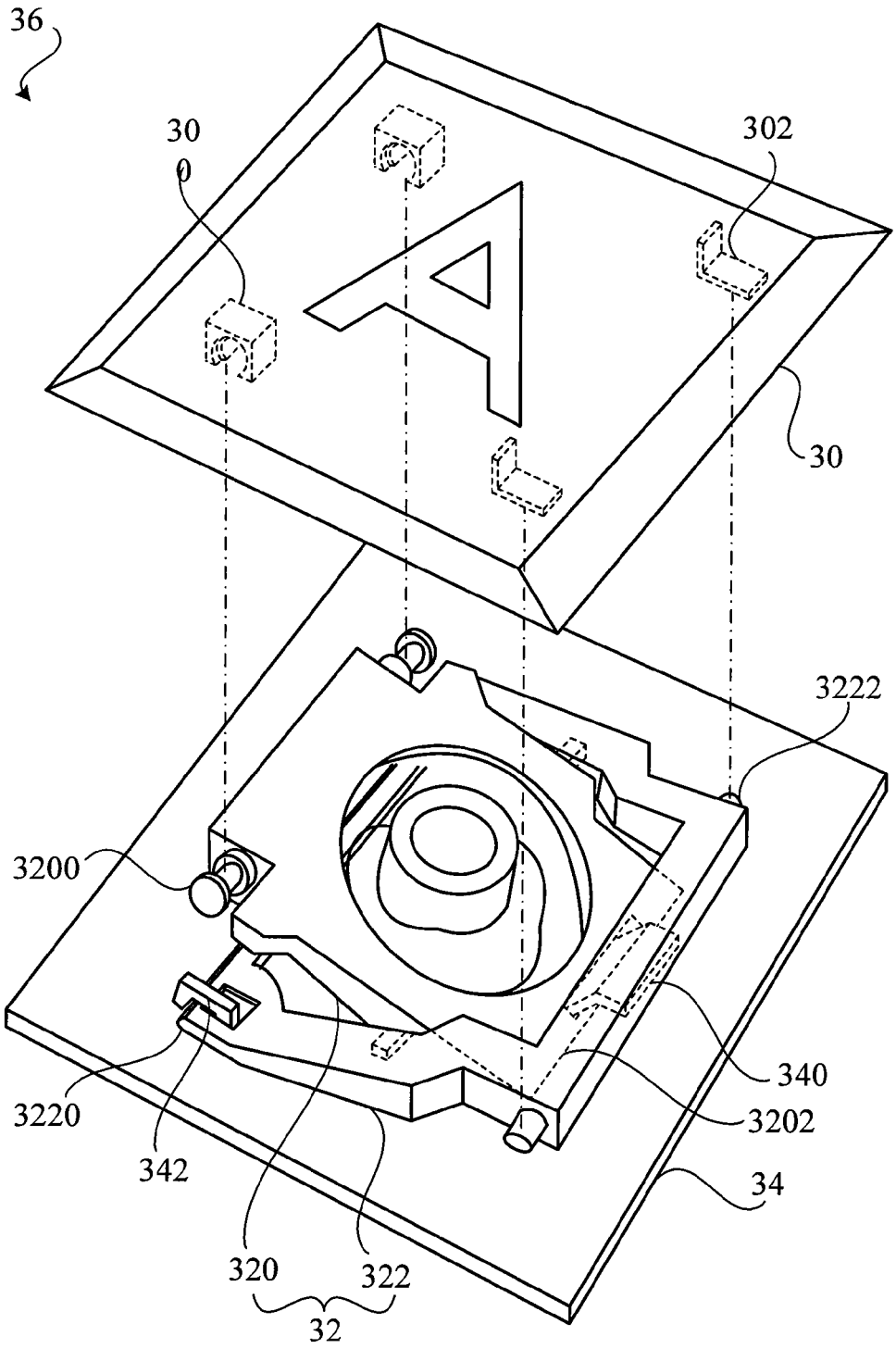
FIG. 3 is a schematic drawing illustrating a keyswitch of the embodiment according to the invention.

For the description of the detail structure of the keyswitch 36 according to the invention, FIG. 3 is drawn additionally. FIG. 3 is a schematic drawing illustrating the keyswitch 36 of the embodiment according to the invention.

As shown in FIG. 3, the keyswitch 36 according to the invention includes the keycap 30, the base plate 34, and the support structure 32. The keycap 30 includes a first engagement part 300 and a second slide part 302. The base plate 34 includes a second engagement part 342 and a first slide part 340. The support structure 32 is disposed between the keycap 30 and the base plate 34 and includes a first support frame 320 and a second support frame 322. The first support frame 320 and the second support frame 322 are cross connected.

The first support frame 320 includes a first end 3200 and a second end 3202. The first end 3200 is connected to the first engagement part 300 of the keycap 30. The second end 3202 slides in the first slide part 340 of the base plate 34. Similarly, the second support frame 322 includes a third end 3220 and a fourth end 3222. The third end 3220 is connected to the second engagement part 342 of the base plate 34. The fourth end 3222 slides in the second slide part 302 of the keycap 30.

Because the features of the invention locate at the engagement relation between the first end 3200 of the first support frame 320 and the first engagement part 300 of the keycap 30, in the following description, there is no further description about the second support frame 322 and about the slide relation between the second end 3202 of the first support frame 320 and the first slide part 340 of the base plate 34.

Figure 4A:
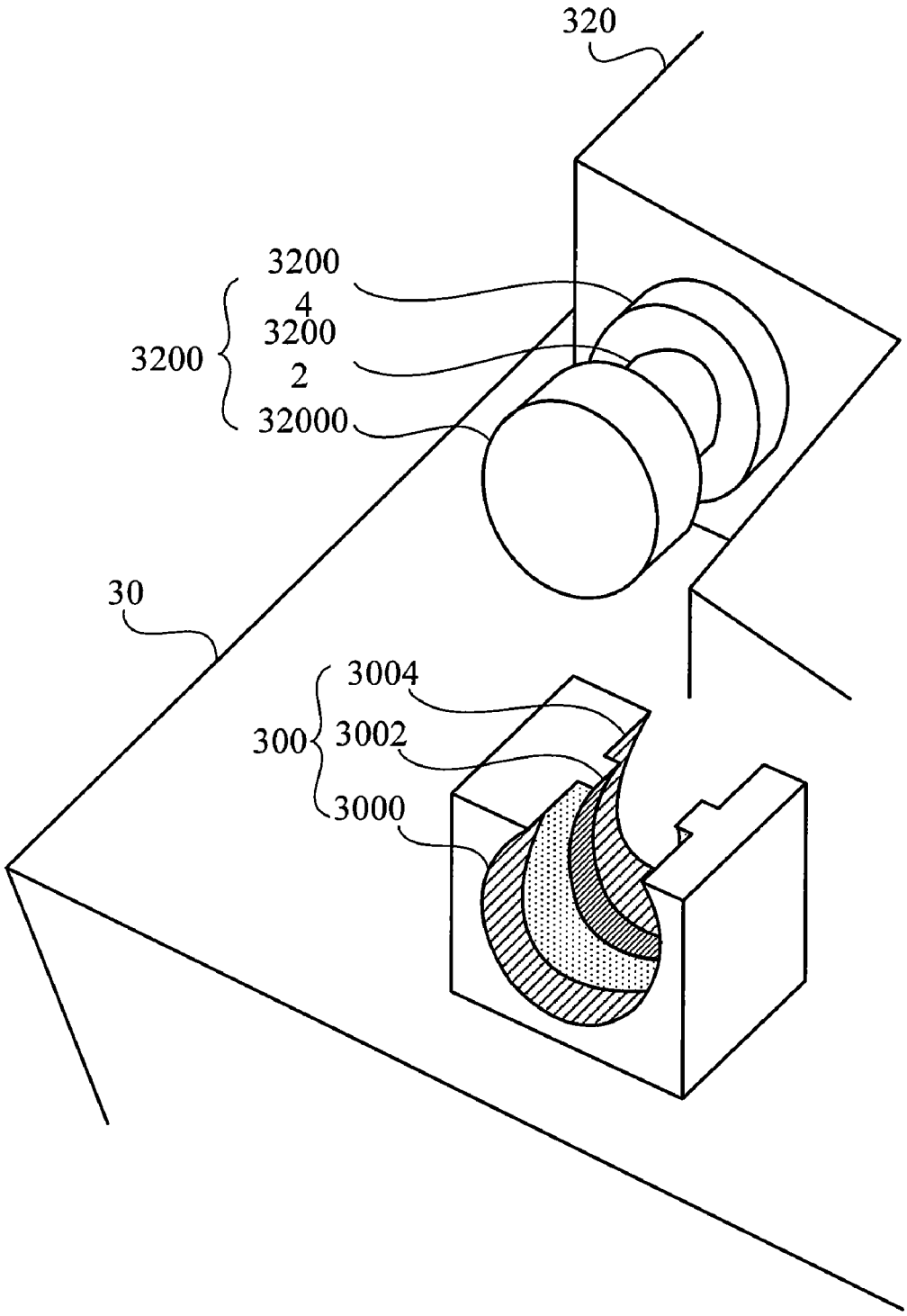
FIG. 4A is a schematic drawing illustrating the first support frame is not connected to the keycap in FIG. 3.
Figure 4B:
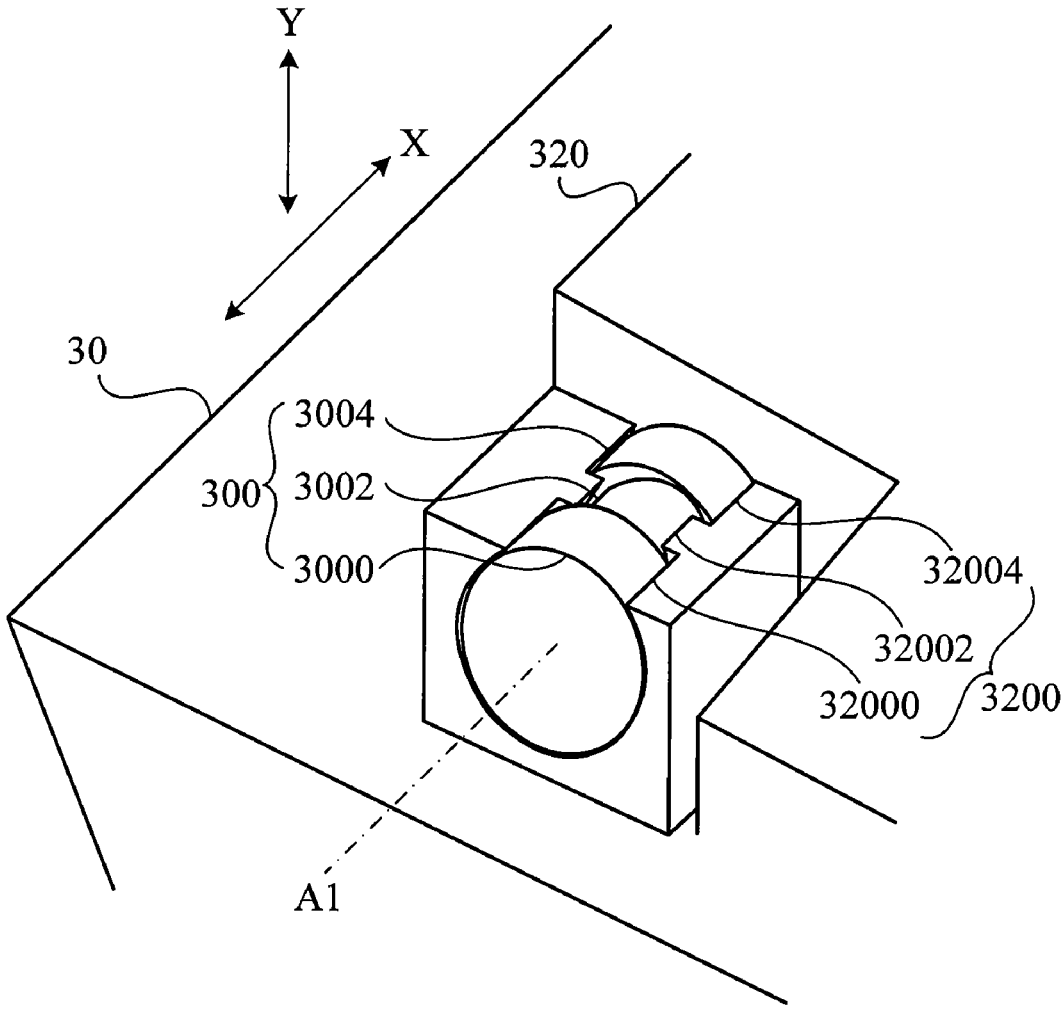
FIG. 4B is a schematic drawing illustrating the first support frame is connected to the keycap in FIG. 3.

For the understanding of the engagement relation of the first support frame 320 and the keycap 30, please refer to FIGS. 4A and 4B together. FIG. 4A is a schematic drawing illustrating the first support frame 320 is not connected to the keycap 30 in FIG. 3. FIG. 4B is a schematic drawing illustrating the first support frame 320 is connected to the keycap 30 in FIG. 3. It is noticed that the view of FIGS. 4A and 4B is opposite to the view of FIG. 3; that is, the view of FIGS. 4A and 4B is the direction from the first end 3200 of the first support frame 320 toward the keycap 30.

As shown in FIG. 4A, the first end 3200 of the first support frame 320 includes a first protrusion part 32000, a second protrusion part 32002, and a third protrusion part 32004. The radial dimensions of the first protrusion part 32000 and the third protrusion part 32004 are larger than that of the second protrusion part 32002. The first engagement part 300 of the keycap 30 includes a first concave part 3000, a second concave part 3002, and a third concave part 3004. The radial dimensions of the first concave part 3000 and the third concave 3004 are larger than that of the second concave part 3002. Each concave part matches the corresponding protrusion part in shape and size. Therefore, after the first support frame 320 is connected to the keycap 30, as shown in FIG. 4B, the first protrusion part 32000 is engaged with the first concave part 3000, the second protrusion part 32002 is engaged with the second concave part 3002, and the third protrusion part 32004 is engaged with the third concave part 3004.

As shown in FIG. 3, when the keycap 30 is pressed to move, the first support frame 320 is pushed to move. Please also refer to FIG. 4B together. The concave parts of the first engagement part 300 are correspondingly engaged with the protrusion parts of the first end 3200, so when the keycap 30 moves together with the first support frame 320, the first protrusion part 32000 will not be detached from the first engagement part 300 but rotate relative to a rotary axis A1.

However, the force loaded on the keycap 30 by a user is not exactly perpendicular to the keycap 30 in fact, so there are not only vertical movement (as the direction Y in FIG. 4B) but also lateral movement (as the direction X in FIG. 4B) on the keycap 30. As shown in FIG. 4A, the concave surface of the second concave part 3002 protrudes out of the concave surfaces of the first concave part 3000 and the third concave part 3004. The radial dimensions of the protrusion parts are different, and the first protrusion part 32000, the second protrusion part 32002, and the third protrusion part 32004 form a space therebetween. Therefore, in FIG. 4B, the second concave part 3002 is in the space formed by the first protrusion part 32000, the second protrusion part 32002, and the third protrusion part 32004. Furthermore, the relative lateral movement between the first engagement part 300 and the first end 3200 is limited so as to achieve the purpose of positioning keyswitch.

Figure 5:
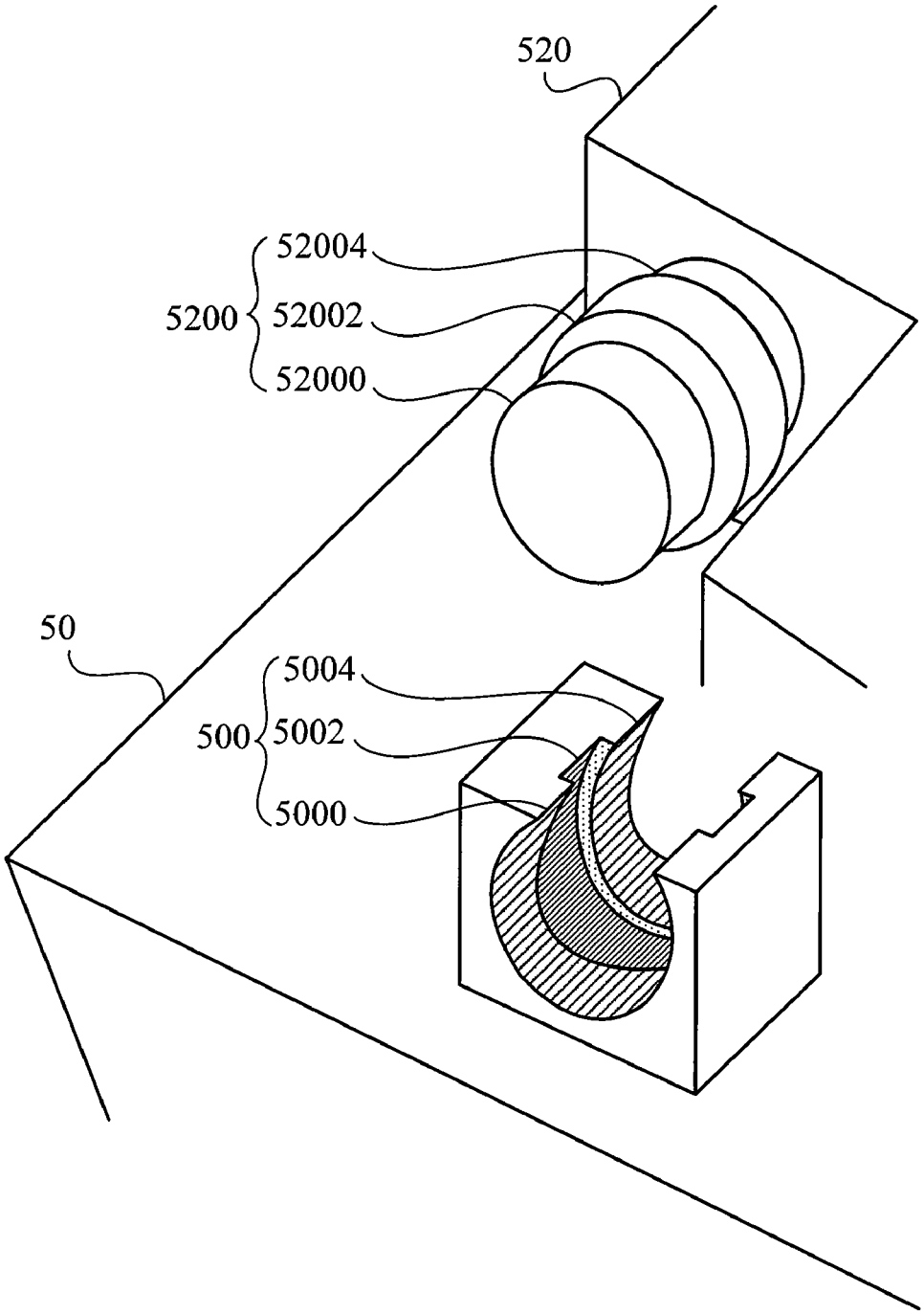
FIG. 5 is a schematic drawing illustrating the first support frame is not connected to the keycap of another embodiment according to the invention.

Of course, the invention is not limited to the structure in FIG. 4A. Please refer to FIG. 5. FIG. 5 is a schematic drawing illustrating the first support frame 520 is not connected to the keycap 50 of another embodiment according to the invention. Compared with FIG. 4A, in FIG. 5, the radial dimensions of the first protrusion part 52000 and third protrusion part 52004 are smaller than that of the second protrusion part 52002. The radial dimensions of the first concave part 5000 and the third concave part 52004 are smaller than that of the second concave part 5002. In FIG. 5, and the radial dimensions of the protrusion parts of the first end 5200 are different, and the concave parts of the first engagement part 500 are different too. Therefore, the embodiment in FIG. 5 could also achieve the purpose of positioning keyswitch.

Compared with the prior art, the engagement structure of the support frame to the keycap is improved in the invention. The first end of the first support frame includes protrusion parts with different radial dimensions, and the keycap also includes concave parts with different radial dimensions so that the protrusion parts could be engaged with the concave parts. Therefore, the invention improved the structure of the protrusion part and the concave part to limit the movement of the keycap; that is, the invention provides a better effect of positioning the keycap. Besides, the keyswitch of the invention is uneasy to sway so that the wear due to the relative movement between the components could be reduced and the stability of the knock on the keyswitch is increased; that is, the feedback feeling of knock is improved.

Figure 6:
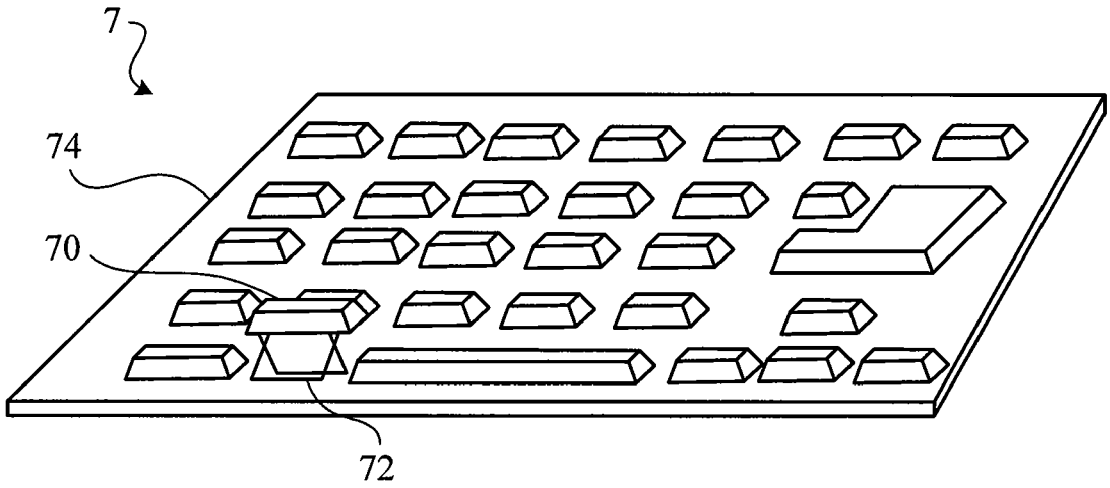
FIG. 6 is a schematic drawing illustrating a keyboard of another embodiment according to the invention.

Please refer to FIG. 6. FIG. 6 is a schematic drawing illustrating a keyboard 7 of another embodiment according to the invention. As shown in FIG. 6, the keyboard 7, similar to the keyboard 3 in FIG. 3, includes a base plate 74, a plurality of keycaps 70, and a plurality of support structures 72. There is one support structure 72 between the base plate 74 and each keycap 70, and the support structure 72 allows the keycap 70 to be capable of vertically moving relative to the base plate 74. Similarly, one keycap 70, one support structure 72, and the base plate 74 are a so-called keyswitch 76.

Figure 7:
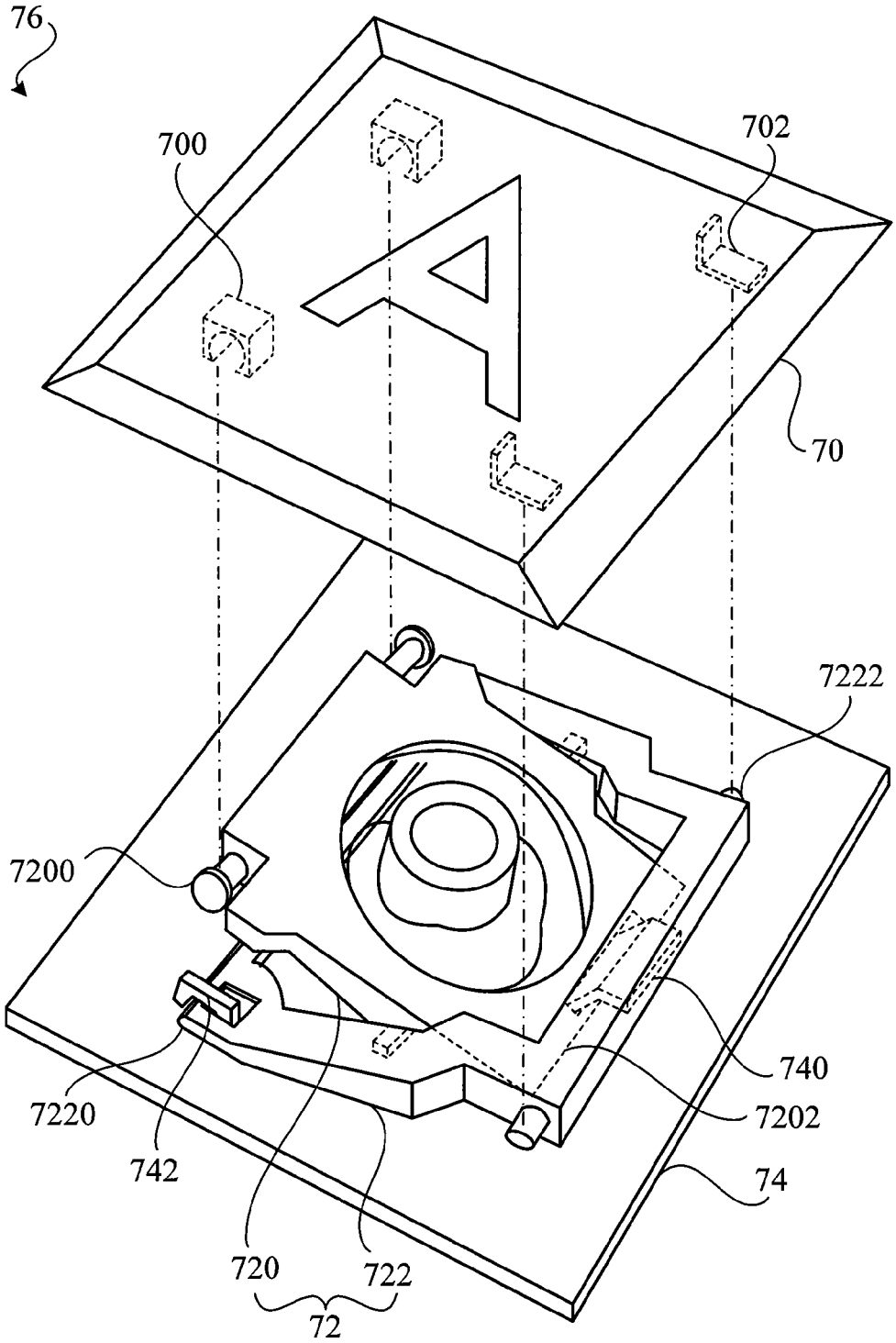
FIG. 7 is a schematic drawing illustrating a keyswitch of the embodiment according to the invention.

For the description of the detail structure of the keyswitch 76 according to the invention, FIG. 7 is drawn additionally. FIG. 7 is a schematic drawing illustrating the keyswitch 76 of the embodiment according to the invention.

As shown in FIG. 7, the keyswitch 76 according to the invention includes the keycap 70, the base plate 74, and the support structure 72. The keycap 70 includes a first engagement part 700 and a second slide part 702. The base plate 74 includes a second engagement part 742 and a first slide part 740. The support structure 72 is disposed between the keycap 70 and the base plate 74 and includes a first support frame 720 and a second support frame 722. The first support frame 720 and the second support frame 722 are cross connected.

The first support frame 720 includes a first end 7200 and a second end 7202. The first end 7200 is connected to the first engagement part 700 of the keycap 70. The second end 7202 slides in the first slide part 740 of the base plate 74. Similarly, the second support frame 722 includes a third end 7220 and a fourth end 7222. The third end 7220 is connected to the second engagement part 742 of the base plate 74. The fourth end 7222 slides in the second slide part 702 of the keycap 70.

Because the features of the invention locate at the engagement relation between the first end 7200 of the first support frame 720 and the first engagement part 700 of the keycap 70, in the following description, there is no further description about the second support frame 722 and about the slide relation between the second end 7202 of the first support frame 720 and the first slide part 740 of the base plate 74.

Figure 8A:
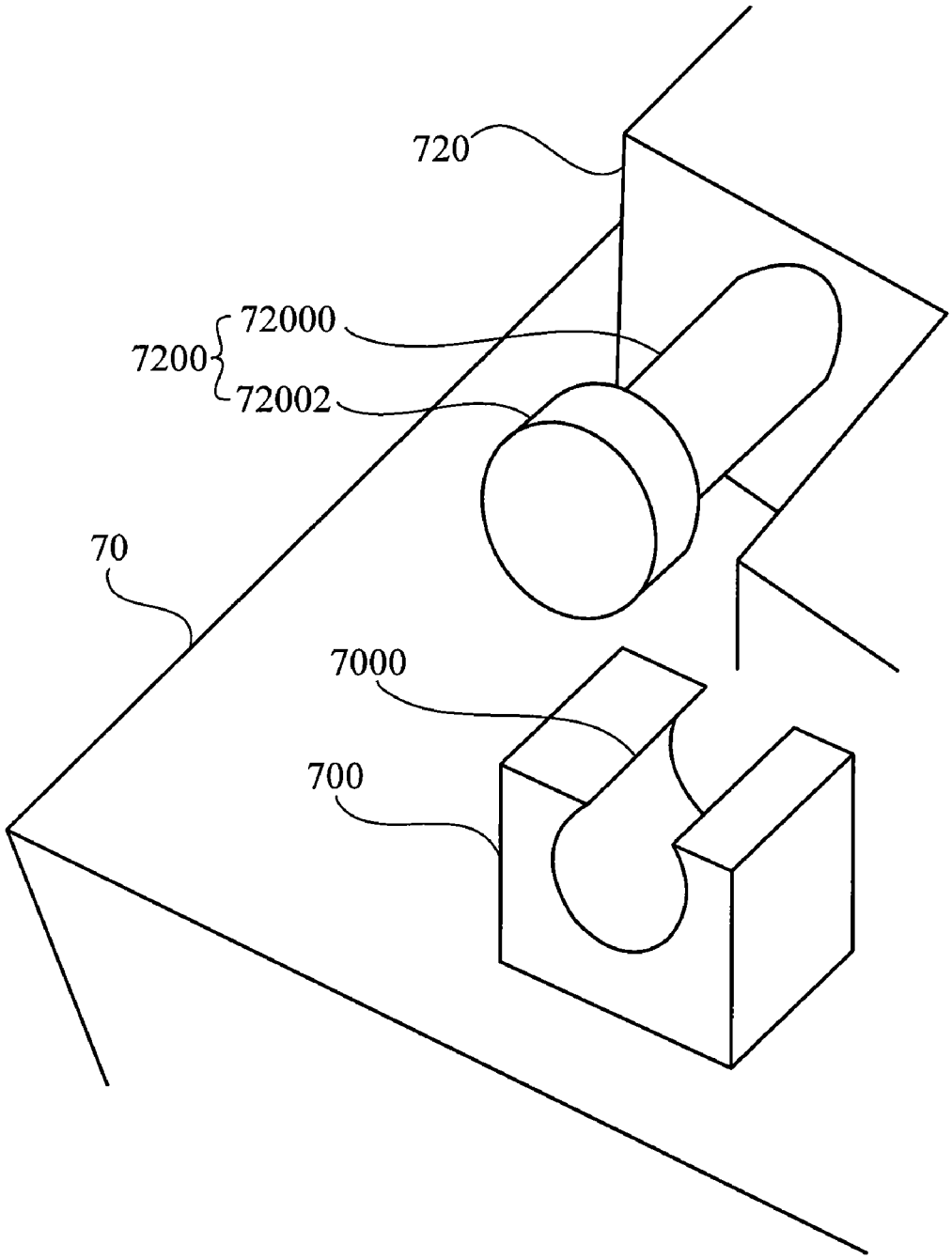
FIG. 8A is a schematic drawing illustrating the first support frame is not connected to the keycap in FIG. 7.
Figure 8B:
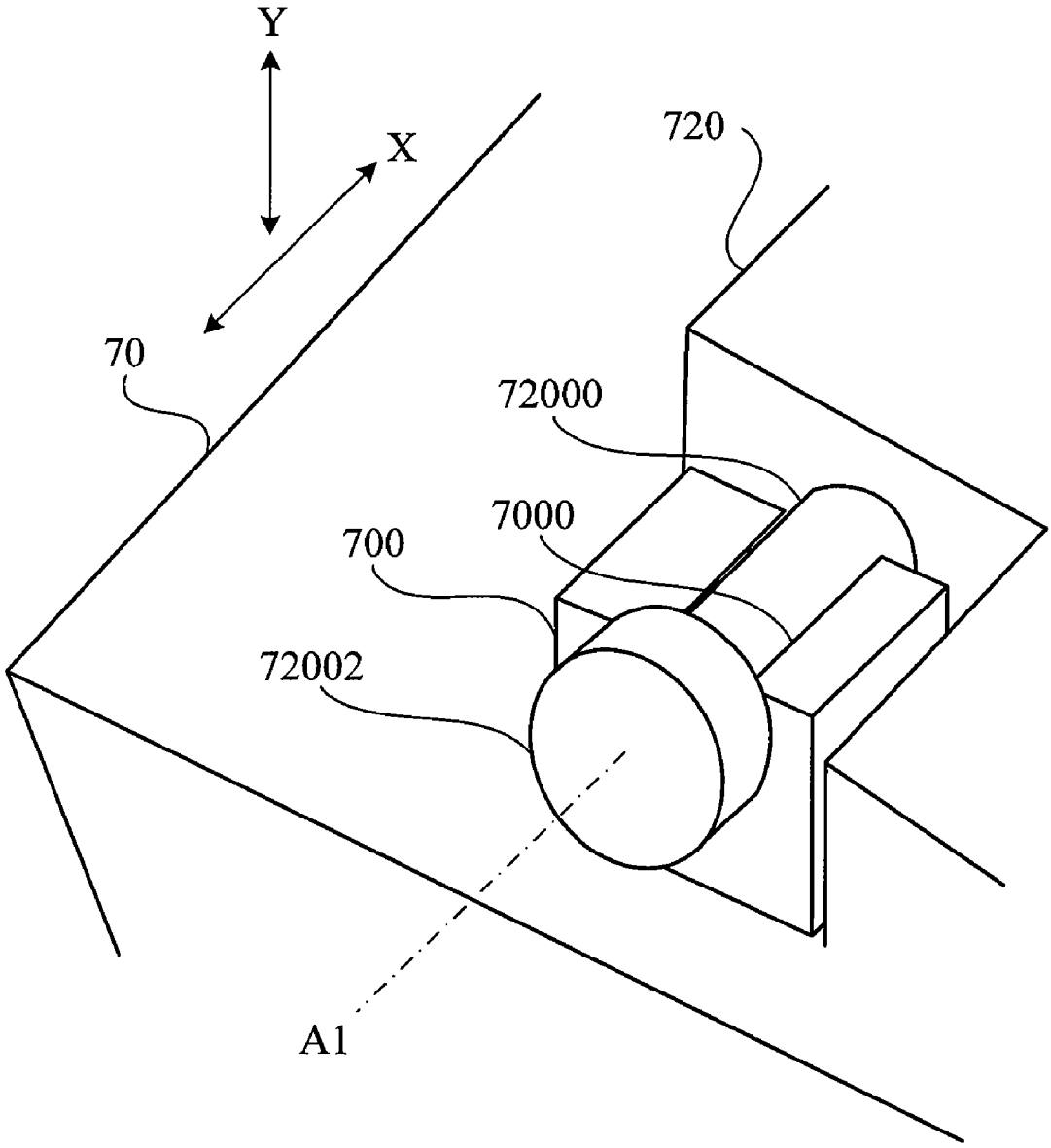
FIG. 8B is a schematic drawing illustrating the first support frame is connected to the keycap in FIG. 7.

For the understanding of the engagement relation of the first support frame 720 and the keycap 70, please refer to FIGS. 8A and 8B together. FIG. 8A is a schematic drawing illustrating the first support frame 720 is not connected to the keycap 70 in FIG. 7. FIG. 8B is a schematic drawing illustrating the first support frame 720 is connected to the keycap 70 in FIG. 7.

As shown in FIG. 8A, the first end 7200 of the first support frame 720 includes a first protrusion part 72000 and a second protrusion part 72002. The radial dimension of the first protrusion part 72000 is larger than that of the second protrusion part 72002. The first engagement part 700 of the keycap 70 includes a concave part 7000, the shape of which matches the shape of the first protrusion 72000. When the first support frame 7320 is connected to the keycap 70 as shown in FIG. 8A, the first protrusion part 72000 is engaged with the concave part 7000, and the second protrusion part 72002 is exposed out and adjacent to a side of the first engagement part 700.

As shown in FIG. 7, when the keycap 70 is pressed to move, the first support frame 720 is pushed to move. Please also refer to FIG. 8B together. The concave part 7000 of the first engagement part 700 limits the movement of the protrusion part 72000, so when the keycap 70 moves together with the first support frame 720, the first protrusion part 72000 will not be detached from the first engagement part 700 but rotate relative to a rotary axis A1.

However, the force loaded on the keycap 70 by a user is not exactly perpendicular to the keycap 70 in fact, so there are not only vertical movement (as the direction Y in FIG. 8B) but also lateral movement (as the direction X in FIG. 8B) on the keycap 70. Through the structure improvement of the invention, as shown in FIG. 8B, the second protrusion part 72002 is exposed out and adjacent to the side of the first engagement part 700, and the radial dimension of the second protrusion part 72002 is larger than that of the first protrusion part 72000. Therefore, the relative lateral movement of the first engagement part 700 to the first end 7200 is limited so as to achieve the purpose of positioning keyswitch.

Figure 9:
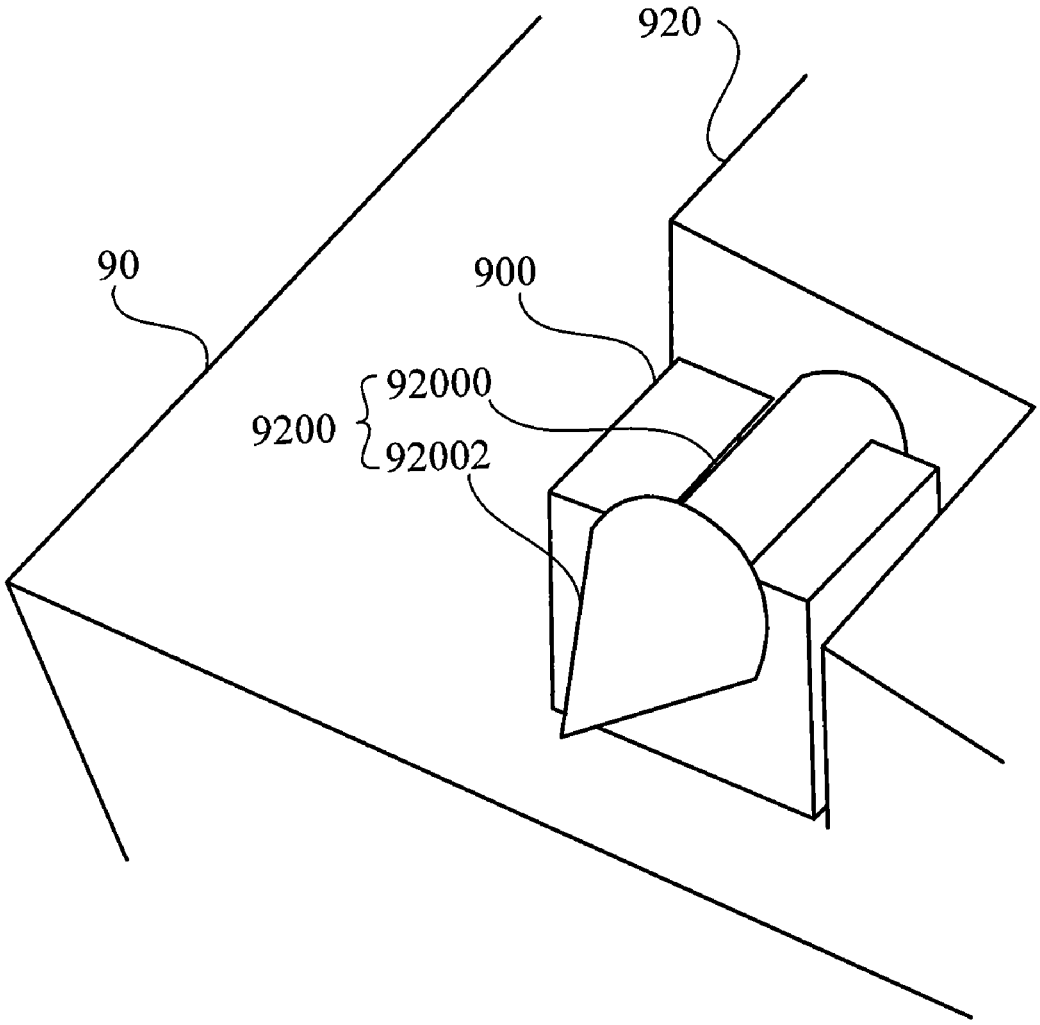
FIG. 9 is a schematic drawing illustrating the first support frame is not connected to the keycap of another embodiment according to the invention.

In addition, the shape the second protrusion part 72002 is not limited to the disk shape in FIGS. 8A and 8B. Please refer to FIG. 9. FIG. 9 is a schematic drawing illustrating the first support frame 920 is not connected to the keycap 90 of another embodiment according to the invention. As shown in FIG. 9, the second protrusion part 92002 of the first end 9200 is a cone. The radial dimension of the bottom of the second protrusion part 92002 (the portion adjacent to the first protrusion part 92000) is larger than the radial dimension of the first protrusion part 92000, and the radial dimension of the top of the second protrusion part 92002 is smaller than the radial dimension of the first protrusion part 92000. The first end 9200 could limit the lateral movement of the first engagement part 900; therefore, the embodiment in FIG. 9 could also achieve the purpose of positioning keyswitch.

Compared with the prior art, the engagement structure of the support frame to the keycap is improved in the invention. The first end of the first support frame further includes a protrusion structure (that is the second protrusion 72002 part in FIG. 8B) exposed out and adjacent to the side of the engagement part of the keycap. The protrusion structure could limit the movement of the keycap. Therefore, the invention provides a better effect of positioning the keycap. Besides, the keyswitch of the invention is uneasy to sway so that the wear due to the relative movement between the components could be reduced and the stability of the knock on the keyswitch is increased; that is, the feedback feeling of knock is improved. In addition, the protrusion structure exposed out of the engagement part of the keycap could raise the resistance force as extracting the keycap, and the raised extraction force of the keycap could make the keycap be connected to the support structure more firmly.

With the example and explanations above, the features and spirits of the invention will be hopefully well described. Those skilled in the art will readily observe that numerous modifications and alterations of the device may be made while retaining the features and spirit of the invention. Accordingly, the above disclosure should be construed as limited only by the metes and bounds of the appended claims.

What is claimed is:

1. A keyswitch, comprising:

a keycap comprising a first engagement part, the first engagement part comprising a first concave part;

a base plate comprising a first slide part; and a first support frame disposed between the keycap and the base plate, comprising:

a first end connected to the first engagement part of the keycap, the first end comprising a first protrusion part and a second protrusion part, a radial dimension of the first protrusion part is different from a radial dimension of the second protrusion part, the first protrusion part is engaged with the first concave part of the first engagement part; and a second end sliding in the first slide part of the base plate.

2. The keyswitch of claim 1, wherein the second protrusion part is exposed out and adjacent to a side of the first engagement part.

3. The keyswitch of claim 1, wherein the first engagement part comprises a second concave part, a radial dimension of the first concave part is different from a radial dimension of the second concave part, and the second protrusion part is engaged with the second concave part of the first engagement part.

4. The keyswitch of claim 3, wherein the first engagement part of the keycap comprises a third concave part, the second concave part is between the first concave part and the third concave part, a radial dimension of the third concave part is different from the radial dimension of the second concave part, the first end of the first support frame comprises a third protrusion part, the second protrusion part is between the first protrusion part and the third protrusion part, a radial dimension of the third protrusion part is different to the radial dimension of the second protrusion part, and the third protrusion part is engaged with the third concave part correspondingly.

5. The keyswitch of claim 4, wherein the radial dimension of the second concave part is larger than the radial dimension of the first concave part and the radial dimension of the third concave part, and the radial dimension of the second protrusion part is larger than the radial dimension of the first protrusion part and the radial dimension of the third protrusion part.

6. The keyswitch of claim 4, wherein the radial dimension of the second concave part is smaller than the radial dimension of the first concave part and the radial dimension of the third concave part, and the radial dimension of the second protrusion part is smaller than the radial dimension of the first protrusion part and the radial dimension of the third protrusion part.

7. The keyswitch of claim 1, further comprising a second support frame, the second support frame being cross connected to the first support frame and comprising a third end and a fourth end, the keycap comprising a second slide part, the base plate comprising a second engagement part, the third end is connected to the second engagement part, the fourth end sliding in the second slide part.

8. A keyboard, comprising:

a plurality of keycaps, each keycap comprising a first engagement part, the first engagement part comprising a first concave part;

a base plate comprising a plurality of first slide parts; and a plurality of first support frames disposed between the keycaps and the first slide parts of the base plate correspondingly, each first support frame comprising:

a first end connected to the first engagement part of the corresponding keycap, the first end comprising a first protrusion part and a second protrusion part, a radial dimension of the first protrusion part is different from a radial dimension of the second protrusion part, the first protrusion part is engaged with the first concave part of the corresponding first engagement part; and a second end sliding in the corresponding first slide part of the base plate.

9. The keyboard of claim 8, wherein the second protrusion part of the first end of each first support frame is exposed out and adjacent to a side of the first engagement part of the corresponding keycap.

10. The keyboard of claim 8, wherein each first engagement part comprises a second concave part, a radial dimension of the first concave part is different from a radial dimension of the second concave part, and each second protrusion part is engaged with the second concave part of the corresponding first engagement part.

11. The keyboard of claim 10, wherein the first engagement part of each keycap comprises a third concave part, the second concave part is between the first concave part and the third concave part, a radial dimension of the third concave part is different from the radial dimension of the second concave part, the first end of each first support frame comprises a third protrusion part, the second protrusion part is between the first protrusion part and the third protrusion part, a radial dimension of the third protrusion part is different to the radial dimension of the second protrusion part, and the third protrusion part is engaged with the third concave part correspondingly.

12. The keyboard of claim 11, wherein the radial dimension of the second concave part is larger than the radial dimension of the first concave part and the radial dimension of the third concave part, and the radial dimension of the second protrusion part is larger than the radial dimension of the first protrusion part and the radial dimension of the third protrusion part.

13. The keyboard of claim 11, wherein the radial dimension of the second concave part is smaller than the radial dimension of the first concave part and the radial dimension of the third concave part, and the radial dimension of the second protrusion part is smaller than the radial dimension of the first protrusion part and the radial dimension of the third protrusion part.

14. The keyboard of claim 8, further comprising a plurality of second support frames, each keycap comprising a second slide part, the base plate comprising a plurality of second engagement parts, the second support frames being between the keycaps and the second engagement parts of the base plate correspondingly, each second support frame being cross connected to the corresponding first support frame and comprising a third end and a fourth end, the third end is connected to the corresponding second engagement part of the base plate, the fourth end sliding in the second slide part of the corresponding keycap.

* * * * *